US006487748B1

(12) United States Patent
Dardar et al.

(10) Patent No.: US 6,487,748 B1
(45) Date of Patent: Dec. 3, 2002

(54) TOOTHBRUSH WITH REPLACEABLE HEAD

(76) Inventors: Jonathan Dardar, 804 Funderburk Ave., Houma, LA (US) 70364; Viveca Dardar, 804 Funderburk Ave., Houma, LA (US) 70364

( * ) Notice: Subject to any disclaimer, the term of this patent is extended or adjusted under 35 U.S.C. 154(b) by 84 days.

(21) Appl. No.: 09/649,683

(22) Filed: Aug. 30, 2000

(51) Int. Cl.[7] ..... A46B 9/04; A46B 7/04

(52) U.S. Cl. ..... 15/167.1; 15/176.1; 15/176.6; 403/329

(58) Field of Search ..... 15/176.1, 176.6, 15/167.1, 167.2, 160; 403/20, 329, 326, 322.1, 325, 321

(56) References Cited

U.S. PATENT DOCUMENTS

| | | | | | |
|---|---|---|---|---|---|
| 68,259 | A | * | 8/1867 | Thayer | 15/176.6 |
| 959,574 | A | * | 5/1910 | Moore | 15/176.1 |
| 1,407,214 | A | * | 2/1922 | Osborn | 15/176.1 |
| 1,415,898 | A | * | 5/1922 | Rost | 15/176.1 |
| 1,567,507 | A | * | 12/1925 | Howard | 15/176.1 |
| 1,682,325 | A | * | 8/1928 | D'Amico et al. | 15/176.1 |
| 2,017,660 | A | * | 10/1935 | Jahn | 15/176.1 |
| 2,648,082 | A | * | 8/1953 | Teetsel | 15/176.1 |
| 2,807,820 | A | * | 10/1957 | Dinhofer | 15/167.2 |
| 4,811,445 | A | | 3/1989 | Lagieski et al. | |
| 5,224,234 | A | * | 7/1993 | Aesenault et al. | 15/176.1 |
| 5,471,701 | A | | 12/1995 | Parfenie | |
| 5,564,152 | A | | 10/1996 | Jeannet et al. | |
| 5,617,884 | A | | 4/1997 | Allison | |
| 5,673,453 | A | | 10/1997 | Huang | |
| 5,737,792 | A | | 4/1998 | Quigless | |

FOREIGN PATENT DOCUMENTS

| | | | | |
|---|---|---|---|---|
| EP | 77869 | * | 5/1983 | 15/176.1 |
| FR | 2559656 | * | 8/1985 | 15/176.1 |
| GB | 24478 | * | 10/1909 | 15/176.1 |
| GB | 339485 | * | 12/1930 | 15/176.6 |

* cited by examiner

*Primary Examiner*—Gary K. Graham
(74) *Attorney, Agent, or Firm*—Anderson & Morishita

(57) ABSTRACT

The present invention is that of a newly designed toothbrush that has a replaceable head. The head of the toothbrush and the base of the toothbrush would have complimentary dove tail shapes ensuring that the pieces would fit together snugly. In addition, the present invention would have a mechanism for securing the two components together. The mechanism would either allow the brush head to be secured to the handle with a locking pin that slips through the head and into a hole in the base of the toothbrush, or alternatively, a locking tab that snaps into the hole in the brush handle.

2 Claims, 4 Drawing Sheets

TOOTHBRUSH WITH REPLACEABLE HEAD

BACKGROUND OF THE INVENTION

The present invention relates to that of a newly designed toothbrush, and more particularly relates to that of a toothbrush with a replaceable head.

DESCRIPTION OF THE PRIOR ART

U.S. Pat. No. 5,737,792, issued to Quigless, discloses a dispensable- head toothbrush and dispenser combination.

U.S. Pat. No. 5,673,453, issued to Huang, discloses a toothbrush which includes a bristle head and an elongated handle. The bristle head has an elongated shaft extending therefrom, and an engagement rib formed axially on an external surface of the shaft.

U.S. Pat. No. 5,617,884, issued to Allison, discloses a dental type hygiene apparatus, comprised of a toothbrush with a detachable, disposable head and an enlarged handle providing a comfortable, secure grip for people with limited rise of the hand.

U.S. Pat. No. 5,564,152, issued to Jeannet et al., discloses an invention which relates to a toothbrush, the brush head of which can be removed from a brush handle.

U.S. Pat. No. 5,471,701, issued to Parfenie, discloses a toothbrush which includes a handle and a brush head removably connected to the handle.

U.S. Pat. No. 4,811,445, issued to Lagieski et al., discloses an oral hygiene system including an aseptic container enclosing a disposable dental hygiene head having a socket for receiving a detachable handle having a male extension for penetrating the aseptic container to engage the socket of the head.

SUMMARY OF THE INVENTION

The present invention is that of a newly designed toothbrush that has a replaceable head. The head of the toothbrush and the base of the toothbrush would have complimentary dove tail shapes ensuring that the pieces would fit together snugly. In addition, the present invention would have a mechanism for securing the two components together. The mechanism would either allow the brush head to be secured to the handle with a locking pin that slips through the head and into a hole in the base of the toothbrush, or alternatively, a locking tab that snaps into the hole in the brush handle.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regard as including such equivalent constructions insofar as they do not depart from the spirit and scope of the present invention.

It is therefore an object of the present invention to provide a new and improved toothbrush with a disposable head which has all of the advantages of the prior art and none of the disadvantages.

It is another object of the present invention to provide a new and improved toothbrush with a disposable head which may be easily and efficiently manufactured and marketed.

It is yet another object of the present invention to provide a new and improved toothbrush with a disposable head which is of durable and reliable construction.

It is still another object of the present invention to provide a new and improved toothbrush with a disposable head which is economically affordable and available to the buying public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
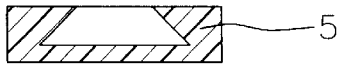
FIGS. 1, 2 and 3 show an end view, a top view, and a perspective view of the base, respectively.
Figure 2:
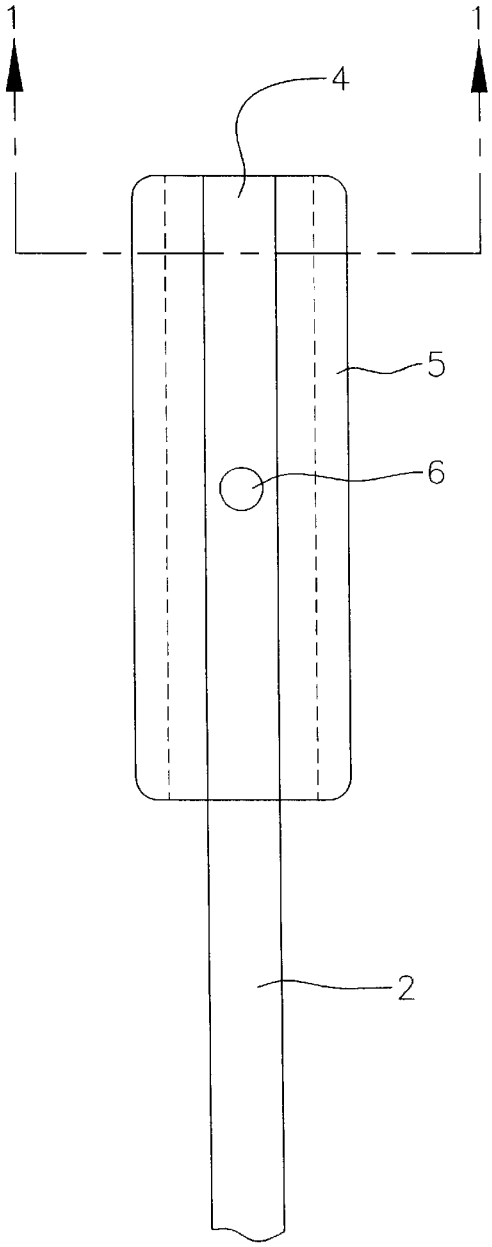
Figure 3:
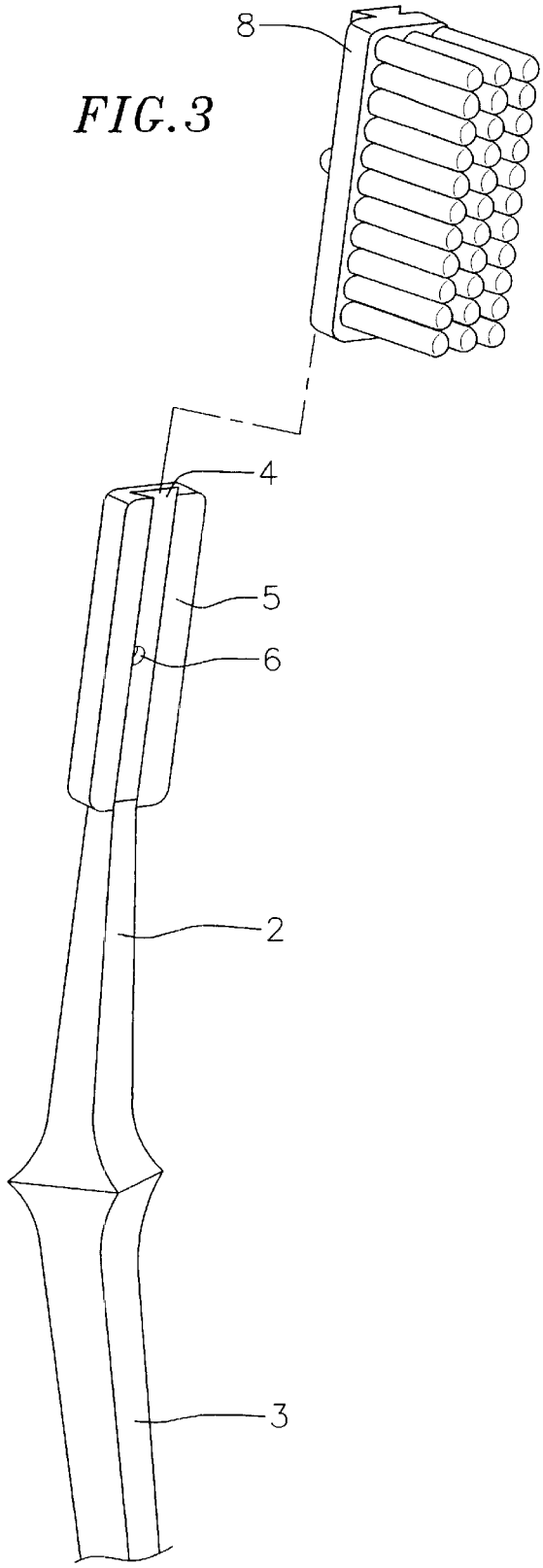

FIGS. 1, 2 and 3 show an end view, a top view, and a perspective view of base 2, respectively. Base 2 includes 2 ends, with handle 3 being located at one end and head attachment portion 5 located at the other end. Head attachment portion 5 has two surfaces, a top surface and a bottom surface. On the top surface of head attachment portion 5 is located track 4, which is centrally mounted hole 6. Track 4 is in the shape of a dove tail to allow retention of objects placed within track 4.

Figure 4:
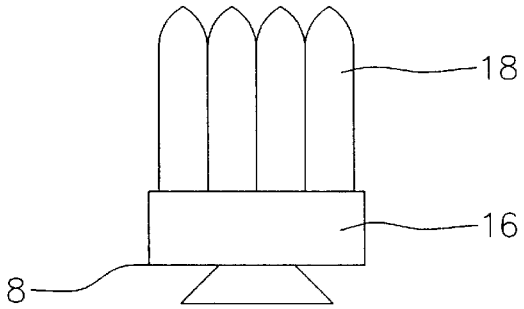
FIGS. 4, 5, and 6 show an end view, a top view, and a side view respectively, of the removable head.
Figure 5:
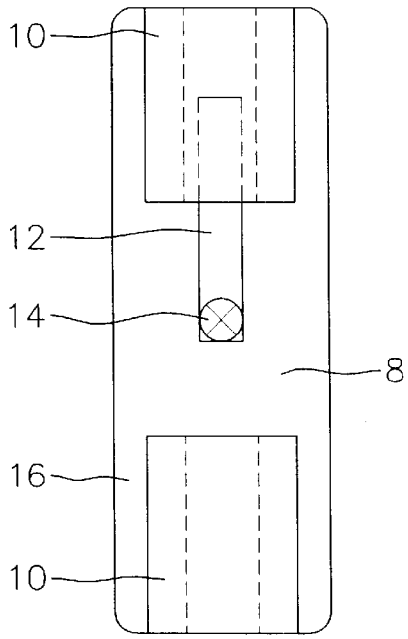
Figure 6:
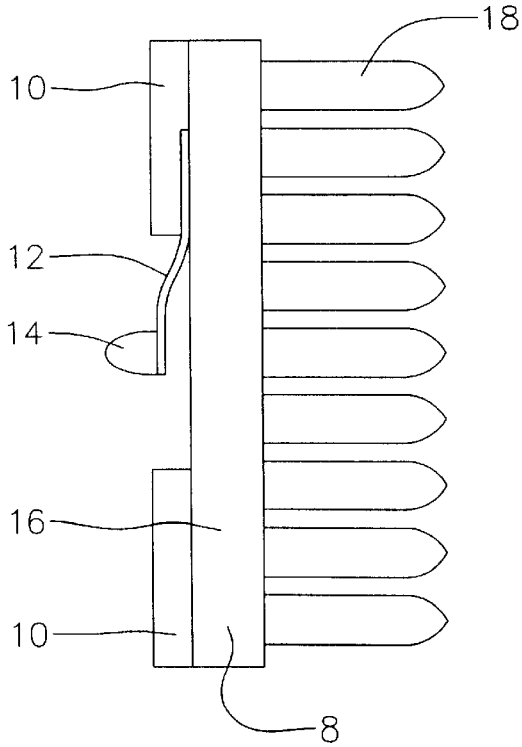

FIGS. 4, 5, and 6 show an end view, a top view, and a side view respectively, of removable head 8. Removable head 8 has centrally located bristle base 16, which has two surfaces, a top surface and a bottom surface. The top surface of bristle base 16 has a plurality of bristles 18 in which a user would use to brush their teeth. The bottom surface of bristle base 16 has a pair of ridges 10 which would be in a dove tail shape complimentary to the dove tail shape of track 4 located on head attachment portion 5. In between the two ridges 10 would be located locking tab 12, which would preferably be stamped from beryllium copper. Beryllium copper has a very high spring tension and is commonly used in oral products and plated with electroplated sulfamate nickel. Locking tab 12 ends in locking pin 14, which snaps into hole 6 when the pair of ridges 10 on removable head 8 are placed within track 4 and removable head 8 is adjusted properly.

To remove removable head 8 from track 4 of head attachment portion 5, a user would place a key 7 into hole 6, and then attempt to slide removable head 8 out of track 4. A user would alternatively be able to use any hard instrument such as a nail file, a small screwdriver, or other such device to be placed within hole 6 in order to release locking pin 14 from hole 6 in an effort to remove removable head 8 from track 4.

Figure 7:
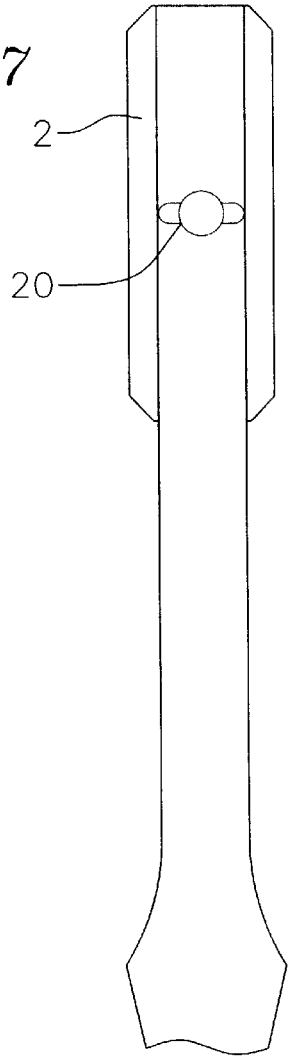
FIG. 7 shows a top view of the base in an alternative embodiment of the present invention.

FIG. 7 shows a top view of base 2 in an alternative embodiment of the present invention. In this embodiment, hole 6 would be replaced by keyhole 20.

Figure 8:
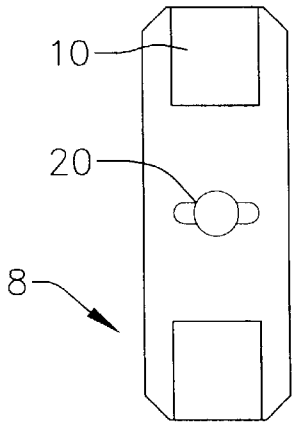
FIGS. 8 and 9, respectively, show a top-view and a side view of removable head in the alternative version of the present invention.
Figure 9:
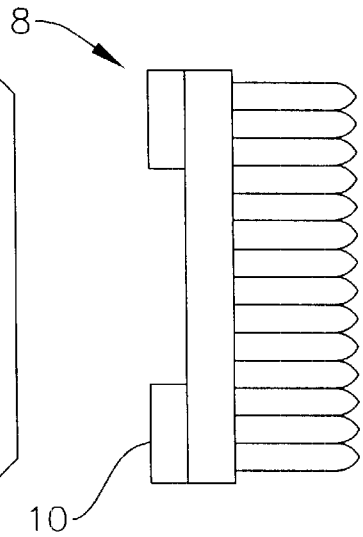

FIGS. 8 and 9, respectively, show a top view, and a side view of removable head 8 in the alternative version of the present invention. Removable head 8 in this alternative embodiment does not include locking tab 12 or locking pin 14, but has centrally mounted keyhole 20 in between the pair of ridges 10.

Figure 10:
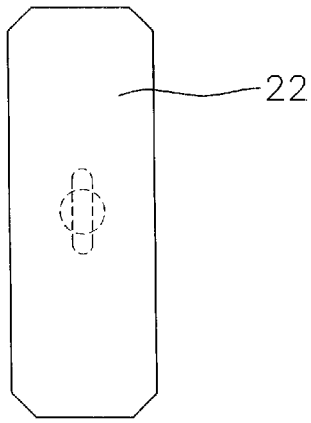
FIGS. 10 and 11, respectively, show a top side view and a side view of the pin used with the alternative embodiment of the present invention.
Figure 11:
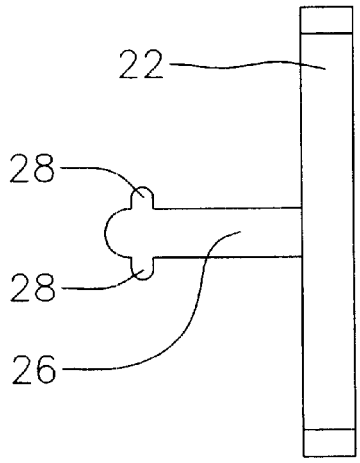

FIGS. 10 and 11, respectively, show a top side view and a side view of the pin used with the alternative embodiment of the present invention. Pin 22 is shaped in the rough approximate shape of a rectangle, and would have two surfaces, a top surface and a bottom surface. The bottom surface would include locking pin shaft 26, which would be an extension jutting out from the bottom surface of pin 22. Locking pin shaft 26 would have a pair of extensions called locking pins 28, which would jut out in perpendicular fashion near the end of pin 22.

Figure 12:
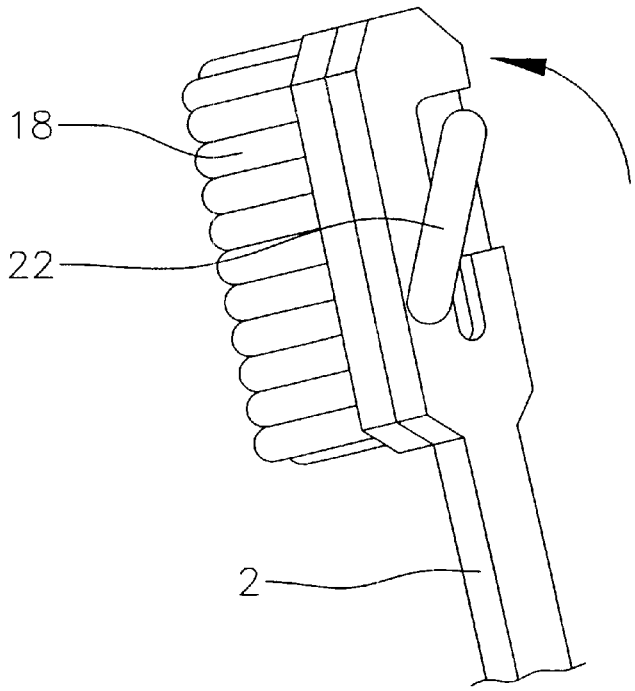
FIG. 12 shows the alternative embodiment of the present invention in use.

FIG. 12 shows the alternative embodiment of the present invention in use. To assemble this alternative embodiment, a user would place removable head 8 onto base. Next, a user would insert locking pins 28 of locking pin shaft 26 through the keyhole 20 in base 2 and on through the keyhole 20 located in removable head 8. The shape of keyhole 20 and removable head 8 would allow a user to insert locking pins 28 in only a specific configuration of pin 22, but once locking pins 28 would be inserted into keyhole 20 of removable head 8, a user would be able to turn pin 22 ninety degrees, allowing locking pins 28 to go into a recess located under the bottom surface of removable head 8. Once locking pins 28 are in a recess, they will be latched tightly together, ensuring that removable head 8 is securely attached to base 2. Removal of removable head 8 and base 2 are effectuated by reversing the process.

What we claim as invention is:

1. A toothbrush comprising:

a. a base including two ends, a first end and a second end, the first end having a handle, the second end having a head attachment portion, the head attachment portion having two surfaces, an upper surface and a lower surface;

b. a track located on the upper surface of the head attachment portion, the track being dove tail shaped;

c. a hole, the hole being centrally located within the track;

d. a removable head, the removable head including a bristle base, the bristle base having two surfaces, an upper surface and a lower surface, a plurality of bristles being located on the upper surface of the bristle base; and e. mounting means associated with the removable head for connecting the removable head to the track, the mounting means comprising:

a pair of ridges, the pair of ridges being located on the lower surface of the removable head, the pair of ridges being shaped in a dove tail shaped complimentary to the dove tail shape of the track;

a locking tab with two ends, a first end and a second end, the first end of the locking tab being connected to the lower surface of the removable head in between the pair of ridges; and a locking pin, the locking pin being attached to the second end of the locking tab, whereby a user would insert the pair of ridges on the removable head into the track located on the toothbrush, whereby the locking pin would connect up with the hole located in the track on the upper surface of the head attachment portion of the base of the toothbrush.

2. At A toothbrush comprising:

a. a base including two ends, a first end and a second end, the first end having a handle, the second end having a head attachment portion, the head attachment portion having two surfaces, an upper surface and a lower surface;

b. a track located on the upper surface of the head attachment portion, the track being dove tail shaped;

c. a keyhole, the keyhole being centrally located within the track;

d. a removable head, the removable head including a bristle base, the bristle base having two surfaces, an upper surface and a lower surface, a plurality of bristles being located on the upper surface of the bristle base; and e. mounting means associated with the removable head for connecting the removable head to the track, the mounting means comprising:

a pair of ridges, the pair of ridges being located on the lower surface of the removable head, the pair of ridges being shaped in a dove tail shaped complimentary to the dove tail shape of the track;

a pin having two surfaces, a top surface and a bottom surface, the pin being in the approximate shape of a rectangle; and a locking pin shaft, having two ends, a first end and a second end, the first end of the locking pin shaft being connected to the bottom surface of the pin, the second end of the locking pin shaft having a pair of locking pins, whereby a user would place the pair of ridges and slide them into the track located on the base of the toothbrush, whereby a user would then place the pair of locking pins on the pin through the keyhole located on the base into a keyhole located on the removable head, whereby a user would turn the pin ninety degrees, allowing the locking pins to go into a recess located within the removable head.

* * * * *